US007122287B2

(12) United States Patent
Asami et al.

(10) Patent No.: US 7,122,287 B2
(45) **Date of Patent: *Oct. 17, 2006**

(54) ELECTROPHOTOGRAPHIC LIQUID DEVELOPER, IMAGE FORMING METHOD AND APPARATUS USING THE ELECTROPHOTOGRAPHIC LIQUID DEVELOPER

(75) Inventors: Tsuyoshi Asami, Yokohama (JP); Kazuo Tsubuko, Numazu (JP); Aiko Ishikawa, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 212 days.

This patent is subject to a terminal disclaimer.

(21) Appl. No.: 10/610,652

(22) Filed: Jul. 2, 2003

(65) Prior Publication Data

US 2004/0005510 A1 Jan. 8, 2004

(30) Foreign Application Priority Data

Jul. 4, 2002 (JP) ..... 2002-196491

(51) Int. Cl.
*G03G 9/13* (2006.01)
*G03G 9/125* (2006.01)

(52) U.S. Cl. ..... 430/114; 430/116; 430/117; 399/237

(58) Field of Classification Search ..... 430/114, 430/116, 117; 399/237
See application file for complete search history.

(56) References Cited

U.S. PATENT DOCUMENTS

| | | | | |
|---|---|---|---|---|
| 4,052,325 | A * | 10/1977 | Santilli | 430/114 |
| 4,985,733 | A | 1/1991 | Kurotori et al. | |
| 5,061,587 | A | 10/1991 | Tsubuko et al. | |
| 5,085,965 | A | 2/1992 | Nanya et al. | |
| 5,099,289 | A | 3/1992 | Kurotori et al. | |
| 5,169,739 | A | 12/1992 | Umemura et al. | |
| 5,189,102 | A | 2/1993 | Tsubuko et al. | |
| 5,328,794 | A | 7/1994 | Kazuo et al. | |
| 5,851,717 | A | 12/1998 | Tsubuko et al. | |
| 5,952,048 | A | 9/1999 | Tsubuko et al. | |
| 6,020,103 | A | 2/2000 | Tsubuko et al. | |
| 6,447,973 | B1 | 9/2002 | Asami et al. | |
| 6,522,852 | B1 | 2/2003 | Tsubuko et al. | |
| 2003/0099894 | A1 * | 5/2003 | Tsubuko et al. | 430/116 |

* cited by examiner

*Primary Examiner*—John L Goodrow
(74) *Attorney, Agent, or Firm*—Oblon, Spivak, McClelland, Maier & Neustadt, P.C.

(57) ABSTRACT

An electrophotographic liquid developer includes a carrier liquid and toner particles. The toner particles include a colorant and a resin component and are dispersed in the carrier liquid. The resin component includes a polyester resin as a main component. When 0.3 g of the liquid developer is dropped on a filter paper (which is defined in JIS P 3801) from a point of 10 mm height, the carrier liquid diffuses in the filter paper at a speed not lower than 1 mm/minute.

31 Claims, 5 Drawing Sheets

ELECTROPHOTOGRAPHIC LIQUID DEVELOPER, IMAGE FORMING METHOD AND APPARATUS USING THE ELECTROPHOTOGRAPHIC LIQUID DEVELOPER

BACKGROUND OF THE INVENTION

1. Field of the Invention

The present invention relates to a liquid developer (sometimes referred to as an electrophotographic liquid developer) for use in electrophotography, electrostatic recording, electrostatic printing and the like and to image forming methods using the electrophotographic liquid developer. In addition, the present invention also relates to an image forming apparatus and method using the liquid developer.

2. Discussion of the Background

Electrophotographic developers are classified into dry developers and liquid developers. Liquid developers have an advantage over dry developers in that clearer images can be prepared because of the inclusion of a toner having a finer particle diameter than that of the toner included in dry developers.

Liquid developers are typically prepared by dispersing a resin, a colorant and a charge controlling agent in a carrier liquid made of a non-aqueous solvent having a high electric resistance. The particle diameter of the toner dispersed in such liquid developers is typically from 0.1 to 2.0 μm.

In the above-mentioned conventional, electrophotographic developers, a non-aqueous solvent having a high boiling point is typically used as the carrier liquid to prevent the carrier liquid from evaporating, resulting in stabilization of the developers. Such a non-aqueous solvent having a high boiling point has good stability, but has a drawback in that fixation of the image is not satisfactory, such that images fade away when rubbed for example by a finger because the carrier liquid tends to remain in a toner layer and on a receiving material after the images are fixed.

Therefore, the development of an electrophotographic liquid developer having high image density and capable of having high resolution image is desired.

SUMMARY OF THE INVENTION

Accordingly, an object of the present invention is to provide an electrophotographic liquid developer which can produce images having good fixability, high density and high resolution right after the images are formed.

Another object of the present invention is to provide an image forming apparatus and method using the electrophotographic liquid developer.

The present inventors have discovered that the above-mentioned poor fixation of an image is believed to be caused by a slow diffusing of the carrier liquid remaining in the image portion on the receiving material after the image is formed. The present inventors have found that controlling the diffusing speed of the carrier liquid of a toner solves the poor fixation problem.

To achieve such objects, the present invention provides an electrophotographic liquid developer including a carrier liquid having a high resistivity and a low dielectric constant and toner particles including a colorant and a resin dispersed in the carrier liquid, wherein the resin includes a polyester resin as a main component, and wherein when 0.3 g of the liquid developer is dropped on a filter paper (which is defined in JIS P 3801) from a point of 10 mm height, the carrier liquid diffuses in the filter paper at a speed not lower than 1 mm/minute.

An acid value of the polyester resin is preferably from 0 to 10 mg/KOH.

A melt index of the polyester resin is preferably from 25 to 700 g/10 minutes (measured at 190±0.4° C. with an applied load of 2160 g±10 g as defined in JIS K 6760).

The colorant is preferably subjected to a flushing treatment using a polyester resin in a presence of a compound selected from the group consisting of humic acid, salts of humic acid and derivatives of humic acid.

The carrier liquid preferably includes a liquid paraffin having a flash point not lower than 130° C. and a viscosity not lower than 3 mPa·sec. as a main component.

The carrier liquid preferably includes a linear silicone oil having a flash point not lower than 210° C.

The liquid developer preferably has a viscosity not less than 100 mPa·sec.

The toner particles are preferably contained in the liquid developer in an amount not less than 10% by weight based on total weight of the liquid developer.

The toner particles preferably have an average particle diameter of from 1 to 5 μm.

An image forming method including applying the above-mentioned liquid developer on a developing member selected from the group consisting of rollers and belts to form a layer of the liquid developer on the developing member, and developing an electrostatic latent image on an image bearing member with the liquid developer on the developing member to form a toner image on the image bearing member.

The layer of the liquid developer preferably has a thickness of from 1 to 15 μm.

The electrostatic latent image is preferably developed after the layer of the liquid developer on the developing member has been subjected to a corona discharge treatment.

The development is preferably performed after a pre-wet liquid is adhered on the electrostatic latent image.

The image forming method may further include transferring the toner image formed on the image bearing member onto an intermediate transfer medium; and transferring the toner image on the intermediate transfer medium onto a receiving material.

A surface of the image bearing member preferably has water and oil repellency.

As a still further aspect of the present invention, an image forming apparatus including an image bearing member, a charger configured to charge the image bearing member, an irradiator configured to irradiate the image bearing member with light to form an electrostatic latent image on the image bearing member, an image developer configured to develop the electrostatic latent image with a layer of a liquid developer formed on a developing member selected from the group consisting of rollers and belts to form a toner image on the image bearing member, a transferring device to transfer a toner image onto a receiving material, and a cleaner configured to clean a surface of the image bearing member, wherein the liquid developer is the above-mentioned liquid developer.

The image forming apparatus preferably further includes a second charger configured to perform corona discharge on the layer of the liquid developer on the developing member.

The image forming apparatus preferably further includes a wetting device configured to apply a pre-wet liquid to the image bearing member having the electrostatic latent image thereon.

The image forming apparatus preferably further includes an intermediate transfer device configured to receive the toner image on the image bearing member and transfer the toner image onto the receiving material.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
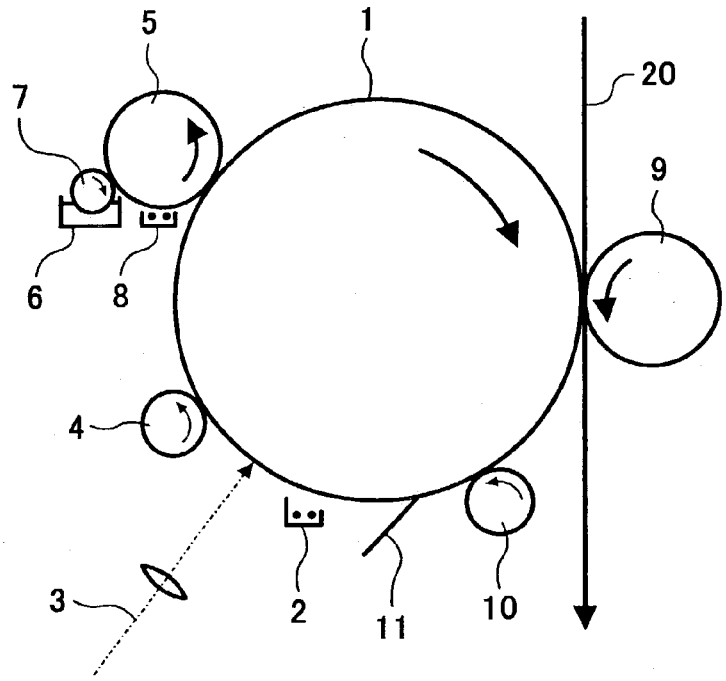
FIG. 1 is a schematic view illustrating an example of the image forming apparatus for use in the image forming method of the present invention.

The electrophotographic liquid developer of the present invention (sometimes referred to as a liquid developer) comprises toner particles and a carrier liquid having a high resistivity and a low dielectric constant. The toner particles include a colorant and a resin including a polyester resin as main components.

In the present invention, a polyester resin is included in a resin as a main component, namely, the polyester resin is included in an amount not less than 50% by weight in the resin component.

The polyester resin for use in the present invention can be prepared by performing polycondensation of a polyhydric alcohol and a polybasic acid.

Specific examples of the polyhydric alcohol include alkylene glycol (aliphatic glycol) and adducts thereof with an alkylene oxide such as ethylene glycol, diethylene glycol, triethylene glycol, propylene glycol (such as 1,2-propylene glycol), dipropylene glycol, butanediol (such as 1,4-butanediol), neopentyl glycol, and 1,6-hexanediol; bisphenol compounds and phenol-based glycol compounds which are adducts of the bisphenol compounds with an alkylene oxide such as bisphenol A and hydrogenated bisphenol; and alicyclic and aromatic diols such as monocyclic or polycyclic diols and triols such as glycerin and trimethylolpropane.

Specific examples of the above-mentioned polybasic acid include saturated or unsaturated dibasic acids such as malonic acid, succinic acid, adipic acid, azelaic acid, sebacic acid, fumaric acid, maleic acid, itaconic acid, phthalic acid and modified acids thereof (for example, hexahydro phthalic anhydride), isophthalic acid and terephthalic acid; saturated polybasic acid having not less than trifunctional groups such as trimellitic acid, trimesic acid, pyromellitic acid and methyl nadic anhydride; and anhydrides and lower alkyl esters thereof.

The polyester resin for use in the present invention can be prepared by performing polycondensation of one or more of these polyhydric alcohols and one or more of the polybasic acids An esterification catalyst can be used for accelerating the reaction. Specific examples of the catalyst include organic metal compounds such as tetrabutylzirconate, zirconium naphthenete, tetrabutyltitanete, tetraoctyltitanete, and stannous oxalate/sodium acetate (3/1).

The polyester resin for use in the present invention preferably has an acid value of from 0 to 10, more preferably from 0 to 5 and most preferably from 0 to 3. When the acid value is within this range, images having good developing property and high quality can be prepared. When the acid value of the polyester resin exceeds 10, negative charging properties increase, resulting in deterioration of the developing properties.

In addition, the polyester resin for use in the present invention preferably has a melt index of from 25 to 700 g/10 minutes. When the melt index is within this range, images having good fixability and good quality can be prepared. When the melt index is lower than 25 g/10 minutes, a toner layer penetrates until a backside of a receiving material by heat thereto, resulting in formation of unsatisfactory images when a double-sided copy is made. In addition, when the melt index is not less than 700 g/10 minutes, heat fusion of toner particles tends to be difficult and the image cannot be fixed at a low temperature.

The melt index is measured at 190±0.4° C. with an applied load of 2160 g±10 g as defined in JIS K 6760.

Adjusting polymerization temperature, reaction system pressure and reaction time can control the melt index of the polyester resin for use in the present invention. In addition, adjusting a mole ratio when reacting carboxylic acid, alcohol, and polymeric molecular weight can control the above-mentioned acid value.

In the present invention, the following resins can be used as the resin of the toner particles other than the polyester resin.

Specific examples of the resins include homopolymers of styrene and substitution compounds of styrene such as polystyrene and polyvinyl toluene styrene copolymers such as styrene-p-chlorostyrene copolymers, styrene-propylene copolymers, styrene-vinyl toluene copolymers, styrene-methyl acrylate copolymers, styrene-ethyl acrylate copolymers, styrene-butyl acrylate copolymers, styrene-methyl methacrylate copolymers, styrene-ethyl methacrylate copolymers, styrene- butyl methacrylate copolymers, styrene-methyl-α-chlormethacrylate copolymers, styrene-acrylonitrile copolymers, styrene-vinyl methyl ether copolymers, styrene-vinyl methyl ketone copolymers, styrene-butadiene copolymers, styrene-isoprene copolymers, styrene-maleic acid copolymers and styrene-maleic acid ester copolymers. In addition, acrylic resins such as methyl methacrylate, ethyl methacrylate, butyl acrylate, butyl methacrylate, lauryl acrylate, lauryl methacrylate, stearyl acrylate, stearyl methacrylate, hydroxymethyl acrylate and hydroxymethyl methacrylate can also be used.

Further, other resins such as polyvinyl chloride, polyvinyl acetate, polyethylene, polypropylene, polyurethane, epoxy resins, polyvinyl butyral, polyacrylic acid, rosins, modified rosins, terpene resins, phenolic resins, aromatic series or aliphatic hydrocarbon resins, aromatic petroleum resins, chlorinated paraffins and paraffin waxes can also be used.

Furthermore, epoxy resins such as polycondensation products of bisphenol A and epochlorhydrin can also be used. For example, commercially available products such as EPOMIC R362, R364, R365, R366, R367 and R369 (manufactured by Mitsui Petrochemical Industries, Ltd.), EPO TOHTO YD-011, YD-012, YD-014, YD-904 and YD-017 (manufactured by Tohto Kasei Co., Ltd.), EPO COAT 1002, 1004 and 1007 (manufactured by Shell Chemicals Japan Ltd.) can be exemplified.

Specific examples of colorants constituting a toner particle of the present invention include inorganic pigments such as PRINTEX V, PRINTEX U, PRINTEX G, SPECIAL BLACK 15, SPECIAL BLACK 4 and SPECIAL BLACK 4-B (Manufactured by Degussa AG), MITSUBISHI #44, #30, MR-11 and MA-100 (Mitsubishi Petrochemical Industries, Ltd.), RABEN 1035, RABEN 1252 and NEWSPECT II (manufactured by Columbian Chemical Company), REGAL 400, REGAL 600, BLACK PEARL 900, BLACK PEARL 1100, BLACK PEARL 1300 and MOGUL L (manufactured by Cabot corporation), and organic pigments such as Phthalocyanine Blue, Phthalocyanine Green, Sky Blue, Rhodamine Lake, Malachite Green Lake, Methyl Violet Lake, Peacock Blue Lake, Naphthol Green B, Naphthol Green Y, Naphthol Yellow S, Naphthol Red, Lithol Fast Yellow 2G, Permanent Red 4R, Brilliant Fast Scarlet, Hansa Yellow, Benzidine Yellow, Lithol Red, Lake Red C, Lake Red D, Brilliant Carmine 6B, Permanent Red F5R, Pigment Scarlet 3B Indigo, Thioindigo Oil Pink and Bordeaux 10B.

These colorants are preferably subjected to a flushing treatment. When the pigments prepared by subjecting these pigments to a flushing treatment are used, a liquid developer which can produce images having good quality can be prepared.

The flushing treatment in the present invention is performed as follows:

A pigment or a pigment paste containing water is mixed with a resin solution or a resin in a kneader called a flusher. The water surrounding the pigment is replaced with the resin solution. The mixture is taken out from the kneader, and the water phase thereof is removed. The mixture containing the pigment kneaded and dispersed in the resin solution or in the resin with heat or at room temperature is dried to remove the solvent, and the resultant block material is pulverized to prepare a colorant powder. In the present invention, the thus prepared product is referred to as a flushed colorant. The water and the solvent may be removed under a reduced pressure during the kneading. In the flushing treatment, the same results can be obtained with using a dye as the pigment when the dye is kneaded with water into a mud-like paste. Thus the flushed dye can also be used as a constituent of the toner.

The weight ratio (C/R) of the colorant to be flushed to the resin (R) is preferably from 10/100 to 60/100. The resins for use in the flushing treatment are preferably the above-mentioned polyester resins.

In addition, it is preferable to perform the flushing treatment in the presence of humic acid, a salt of humic acid (such as Na salt and $NH_4$ salt), or a derivative of humic acid as images having good fixability, high density, high resolution can be produced. An appropriate quantity of the added humic acid is from 0.1 to 30% by weight based on the colorant-containing liquid.

Published unexamined Japanese Patent Application No. 59-102253 discloses the constitution of a colorant obtained by being subjected to a flushing treatment in the presence of humic acid, a salt of humic acid or a derivative of humic acid and the preparation method thereof.

The weight ratio (C/R) of the colorant (C) to the resin (R) which constitutes the toner particle is preferably from 10/100 to 330/100. The below-mentioned carrier liquid having a high resistivity and a low dielectric constant is used, and it is preferable to add a polarity control agent if desired.

In the present invention, a main component of a carrier liquid having a high resistivity and a low dielectric constant in which toner particles are dispersed is preferably a liquid paraffin. When the liquid paraffin is used, a carrier liquid having a diffusing speed in a filter paper of not lower than 1 mm/minute can be easily prepared.

Specific examples of liquid paraffins include CRYSTOL J-52, CRYSTOL J-72, CRYSTOL J-102, CRYSTOL J-142, CRYSTOL J-172, CRYSTOL J-202, CRYSTOL J-262, CRYSTOL J-322, CRYSTOL J-352, ESSO WHITE OIL M-52, ESSO WHITE OIL M-72, ESSO WHITE OIL M-82, ESSO WHITE OIL M-172, ESSO WHITE OIL M-352 (manufactured by Esso Sekiyu K.K.) and the like.

The liquid paraffin for use in the liquid toner preferably has a flash point not lower than 130° C. and a viscosity not less than 3 mPa·s at 40° C. Such liquid paraffins have high affinity for toner particles, the resultant toner has high stability with elapse of time, and strong high charge-retaining ability force and can produce images having good image property and good transferability. In addition, since the liquid paraffin has a desirable diffusion speed, images having good fixation can be produced. Since the liquid paraffin has good pigment dispersibility, diameter of toner particle can be efficiently decreased in a short period of time. Therefore, images having high density and high resolution can be produced. In addition, when the liquid paraffin is used, emissions of a solvent gas can be cut when an image is fixed.

The carrier liquid having a high resistivity and a low dielectric constant includes a liquid paraffin as a main component and preferably includes a silicone oil having a flash point not lower than 210° C. For example, by dispersing toner particles in a liquid paraffin with a dispersing machine to a certain extent, and adding a silicone oil thereto while continuing dispersing, the dispersion can be efficiently performed. In addition, by properly adjusting the ratio of the liquid paraffin to silicone oil depending on the properties of the toner particles, a carrier liquid having a desirable diffusing speed can be prepared.

Specific examples of the silicone oils include KF 96 having a viscosity of from 20 to 10,000 cst (manufactured by Shin-Etsu Silicone co., Ltd.), SH 344 (manufactured by Toray Silicone Industries, Inc.), TSF 451 series, TSF 404 series (ring dimethylpolysiloxane) and TSF 4704 (amino-modified silicone) (manufactured by Toshiba Silicone Co., Ltd.).

The contents of a liquid paraffin to the silicone oil in a carrier liquid are from 50 to 100% by weight and from 0 to 50% by weight, and preferably from 70 to 95 by weight and from 5 to 30% by weight, respectively. When the content of the liquid paraffin is lower than 50% by weight, a problem in that a dispersibility of a pigment deteriorates, resulting in deterioration of dispersion efficiency of toner particles, resolution and coloring property of the resultant images. In addition, the affinity of the toner particle for a dispersion medium tends to deteriorate, resulting in deterioration of stability of resultant images with elapse of time and preservability of the image. When the content of the liquid paraffin is higher than 95% by weight, an offset problem occurs at a fixing roller, and the fixation of the resultant images tends to deteriorate.

For example, the liquid developer in the present invention can be prepared as follows.

A colorant, a binder resin, a carrier liquid are added in a dispersing machine such as ball mills, KITTY mills, disk mills or pin mills to be dispersed and kneaded to prepare a concentrated toner. The liquid developer of the present invention can be prepared by dispersing the concentrated toner in a carrier liquid.

The liquid developer preferably has a viscosity not less than 100 mPa·s (measured by a B type viscometer while the rotor is rotated at a revolution of 60 rpm) . When the viscosity is within this range, the liquid developer can be coated well onto a developing roller and a belt, resulting in formation of good image with high density and good solid-image uniformity. When the viscosity is too low, a thin layer of the liquid developer cannot be formed uniformly.

The contents of the toner particle in the liquid developer (namely, the ratio of the colorant and resin in the liquid developer) is preferably not less than 10% by weight based on total weight of the liquid developer to form images having high density and good solid-image uniformity. When the content is too low, a problem in that the resultant image can have low density.

In addition, the average particle diameter of the toner particles in the liquid developer is preferably from 1 to 5 μm to form images having high density, good solid-image uniformity and resolution. When the average particle diameter of the liquid developer is too small, a problem in that the resultant image can have low image density tends to occur. When the average particle diameter is too large, a problem in that the resultant image can have low resolution tends to occur.

Figure 5A:
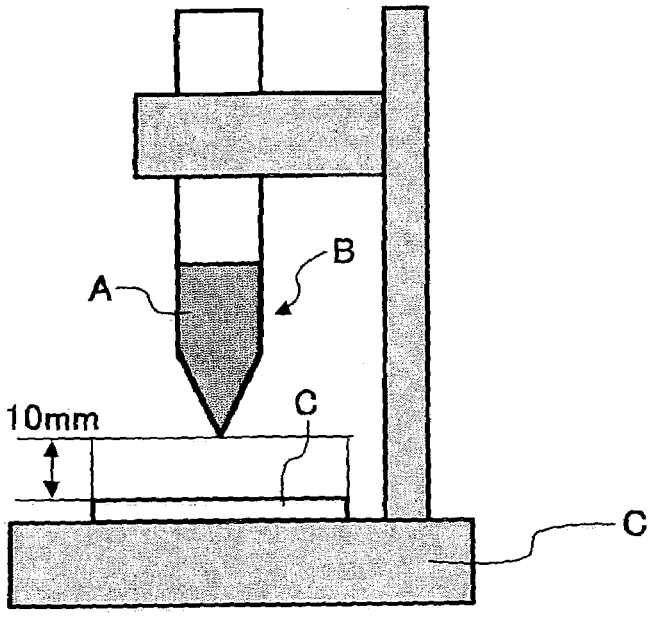
FIG. 5*a* is a schematic view illustrating the measuring method of diffusing speed of a carrier liquid in a filter paper in the present invention.
Figure 5B:
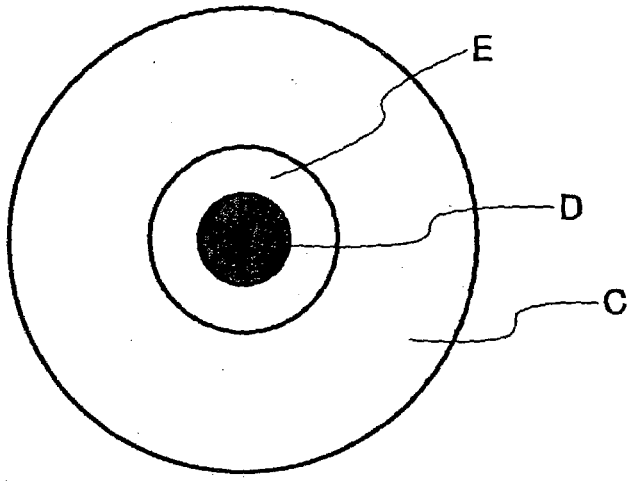
FIG. 5*b* is a schematic view illustrating the measuring method of diffusing speed of a carrier liquid in a filter paper in the present invention.

A carrier liquid in the liquid developer of the present invention has the following diffusing speed, wherein when 0.3 g of the liquid developer is dropped on a filter paper (which is defined in JIS P 3801) from a point of 10 mm height, speed which the carrier liquid in the liquid developer diffuses in the filter paper at a speed not lower than 1 mm/minute. The diffusing speed is measured by an instrument illustrated in FIG. 5. At first, 0.3 g of a liquid developer A is dropped from a toner dropping burret B on a filter paper C (No. 2 manufactured by Toyo Roshi Kaisha, Ltd.) which is set on a toner dropping platform F, from a point of 10 mm height, a toner layer D having a diameter of about 5 mm is formed on the filter paper C. Then the carrier liquid E is diffused at a speed of not lower than 1 mm/minute. Thus, the diffusing speed of the liquid developer of the present invention is fast. When an image is formed with an electrostatic copier, a toner layer formed on a photoreceptor is transferred to a receiving material. Since a carrier liquid transferred on the receiving material is smoothly diffused in the receiving material, the image can have good fixation and the image does not fade when rubbed with a finger. When the diffusing speed is slower than 1 mm/minute, the resultant image does not have enough fixation.

Filter paper No. 2 manufactured by Toyo Roshi Kaisha, Ltd. corresponds to the filter paper type 2 of JIS P 3801. The filter paper type 2 of JIS P 3801 will be explained later.

In this image forming method, an electrostatic latent image is developed with a thin layer of the liquid developer formed on a roller or a belt and having a thickness of preferably from 1 to 15 μm, and more preferably from 3 to 10 μm. When the layer is too thin, the resultant image has low image density. When the layer is too thick, resolution of the resultant image deteriorates.

When an electrostatic latent image is developed with a developer, it is preferable that the thin layer is subjected to a corona discharge in advance to improve cohesion of the toner, and sharpness and resolution of the resultant images. The polarity of the corona discharging is preferably the same as that of the toner and the voltage is preferably from 500 to 8000 V.

An electrostatic latent image is preferably developed after a pre-wet liquid has been adhered thereon, so that the transfer efficiency can be improved and high quality images can be produced. The thickness of the pre-wet liquid layer is preferably from 0.1 to 5 μm, and more preferably from 0.3 to 1 μm. When the layer is too thin, the resultant images have low image density. When the layer is too thick, resolution of the resultant images deteriorate.

It is preferable that after an electrostatic latent image is developed, the toner image is transferred to an intermediate transfer medium, and then transferred to a receiving material, because the transfer property of the toner image can be improved due to application of a pressure to the intermediate transfer medium, resulting in formation of high quality image. Specific examples of the materials of the intermediate transfer mediums include materials having good solvent resistance and elasticity such as urethane rubbers, nitrile rubbers and hydrin rubbers, which are preferably coated with a fluorocarbon resin.

When a surface of the photoreceptor on which an electrostatic latent image is to be formed has water and oil repellency (i.e., the surface has a contact angle not less than 30°), the transfer efficiency and cleaning property of toner images are improved, so that a high quality image can be produced. Increase of water repellency and oil repellency can be achieved by coating a fluorocarbon resin containing block polymer such as MODIPER F200 and 210 manufactured by Nippon Yushi co., Ltd.

Next, the image forming method of the present invention will be explained in detail referring to figures.

FIG. 1 is a schematic view illustrating an example of the image forming apparatus for use in the image forming method of the present invention. In FIG. 1, a photoreceptor 1 (for example, organic photoconductor, selenium or amorphous silicon) rotates in a direction as indicated by an arrow and is charged by a corona charger 2. Numeral 3 denotes an irradiating portion for writing. Numeral 4 denotes a roller used when a carrier liquid serving as a pre-wet liquid is applied to the photoreceptor 1. Numeral 5 denotes a developing roller on which a liquid toner (a liquid developer) which is supplied from a toner container 6 is applied uniformly with a toner roller 7. The liquid toner layer formed on the developing roller 5 is optionally applied with a voltage by a corona discharging portion 8. A latent image on the photoreceptor 1 is developed with the toner in the liquid toner layer formed on the developing roller 5, resulting in formation of visual images on the photoreceptor 1. Each of the rollers can be made of a metal, rubber, plastic or sponge and can be a grooved roller such as wire bars or gravure rollers.

The toner image formed on the photoreceptor 1 is transferred to a receiving material 20 by a transfer roller 9. The transfer is performed by pressure, corona discharge, heat, a combination of heat and pressure, a combination of corona discharge and pressure or a combination of corona discharge and heat, so that the image is formed on the receiving material.

The toner remaining on the photoreceptor 1 is removed by a cleaning roller 10 and a cleaning blade 11 to clean a surface thereof and the photoreceptor prepares for the next image formation.

Figure 2:
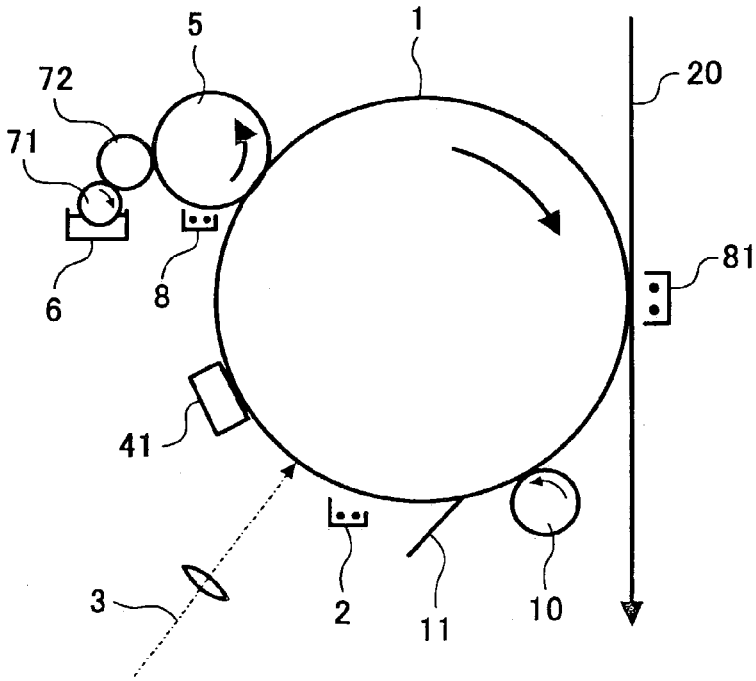
FIG. 2 is a schematic view illustrating another example of the image forming apparatus for use in the image forming method of the present invention.

An image forming apparatus illustrated in FIG. 2. differs from the image forming apparatus illustrated in FIG. 1 in that a pre-wet liquid is coated with a felt 41 instead of the roller 4 and the liquid toner (liquid developer) is supplied from the toner container 6 to the developer roller 5 via rollers 71 and 72. The thus prepared toner layer is applied with a direct current voltage by a corona discharger 81. The quantity of the liquid developer provided to the developing roller 5 can be severely controlled by using such a system that the liquid developer supplied from the toner container 6 is coated on the developer roller 5 via rollers 71 and 72. In addition, the developing roller 5 in FIG. 2 has a relatively large contact width with a photoreceptor 1 compared with that in the case of the apparatus in FIG. 1, so that the latent image is sufficiently developed. The toner image developed on the photoreceptor 1 is transferred to a receiving material 20 by a corona discharger 81 to form an image thereon.

Figure 3:
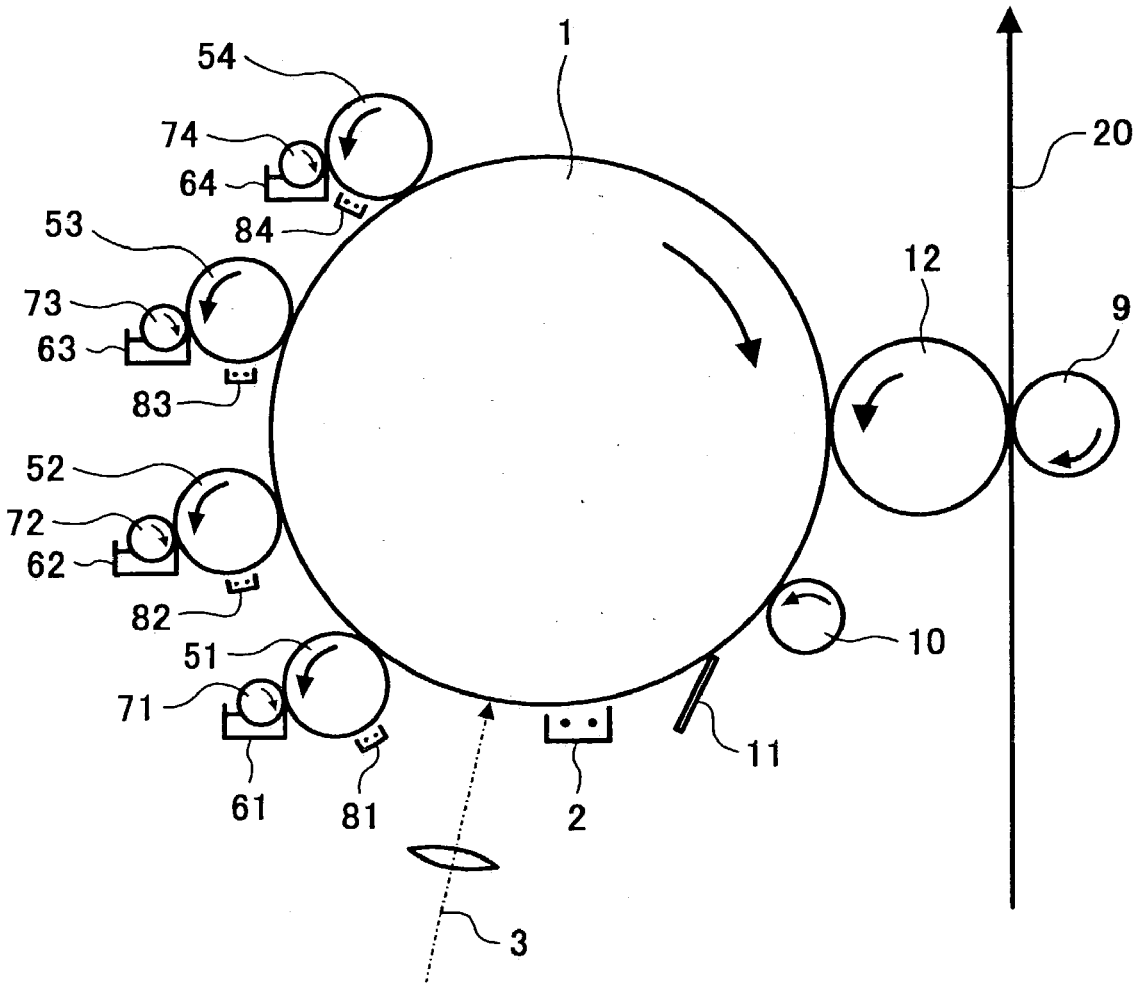
FIG. 3 is a schematic view illustrating yet another example of the image forming apparatus for use in the image forming method of the present invention.

FIG. 3. illustrates an example of the color image forming apparatus for generating color copies. Toner containers 61, 62, 63 and 64 for yellow, magenta, cyan and black toners are provided in the image forming apparatus. Color liquid developers contained in the containers 61, 62, 63 and 64 are transferred to developing rollers 51, 52, 53 and 54 by toner rollers 71, 72, 73 and 74, respectively. Thus, yellow, magenta, cyan and black color liquid developer layers are formed on the developing rollers 51, 52, 53 and 54, respectively. Electrostatic latent images on the photoreceptor 1 are developed with the respective color liquid developer layer and the developed images are transferred to an intermediate transfer roller 12. Thereafter, the color image on the intermediate layer is transferred to a receiving material 20 using a transfer roller 9 by pressure. In this case, corona discharge, heat and the like method can be used instead of pressure.

Numerals 81, 82, 83 and 84 denote corona chargers configured to charge the developer layers formed on the developing rollers 51, 52, 53 and 54, respectively.

Figure 4:
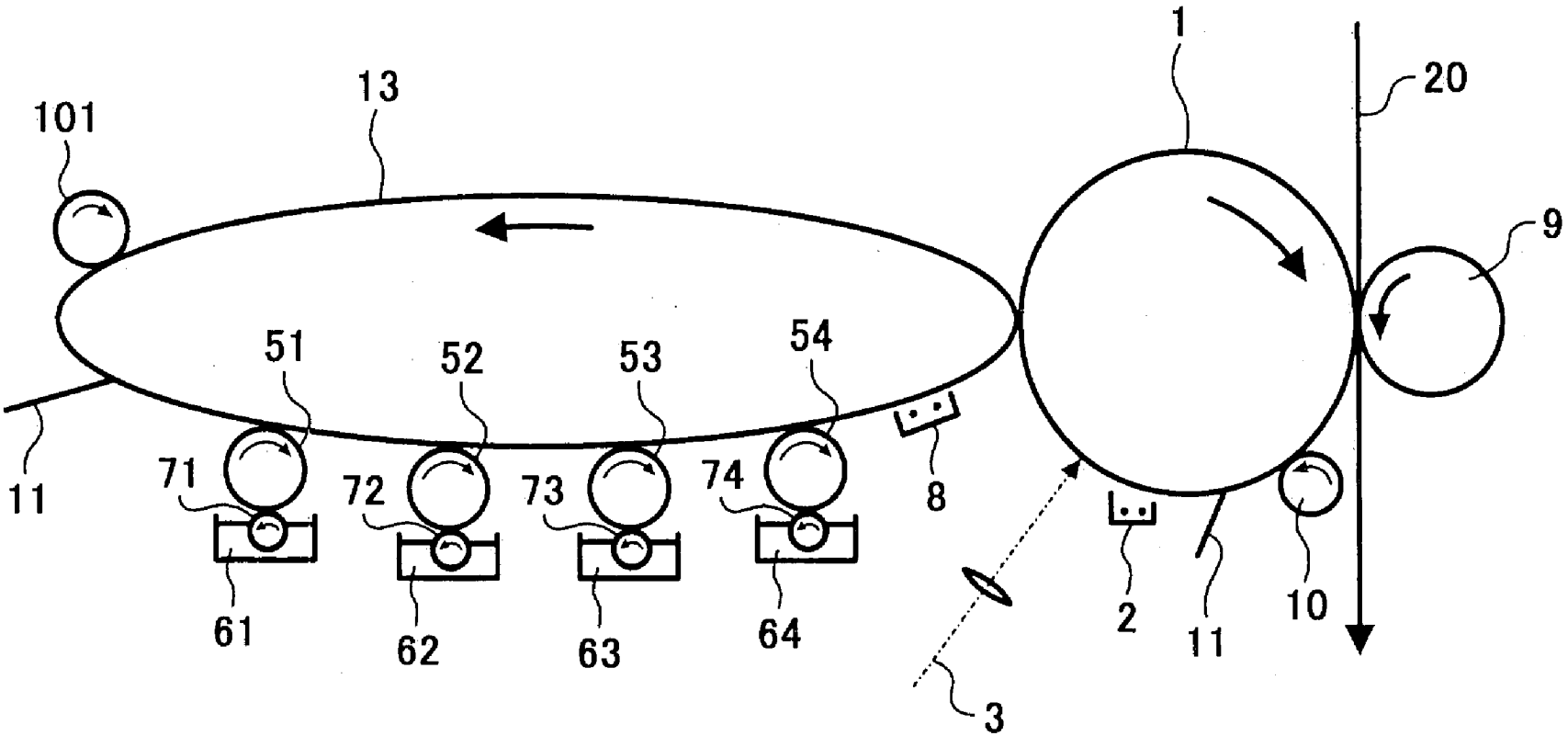
FIG. 4 is a schematic view illustrating a further example of the image forming apparatus for use in the image forming method of the present invention.

FIG. 4 illustrates another example of the color image forming apparatus for generating color copies. Similar to the image forming apparatus in FIG. 3, developer containers 61, 62, 63 and 64 for yellow, magenta, cyan and black toners are provided. Each developer is applied to a belt 13 from each of the toner containers 61, 62, 63 and 64 via toner rollers 71, 72, 73 and 74 and developer rollers 51, 52, 53 and 54 to form color toner image on the photoreceptor 1. The developed image is transferred to a receiving material 20. The belt 13 for coating the toner layer is cleaned by a cleaning roller 10 and a cleaning blade 11.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Polyester Resin (1)

The following components were placed in a separable flask wherein air was replaced with nitrogen gas.

| | |
|---|---|
| Ethylene glycol | 1800 g |
| Terephthalic acid | 600 g |

Then a dehydrating polycondensation reaction was performed at 230° C. to prepare a polyester resin (1) having an acid value of 2.5 mg/KOH and a melt index of 180 g/10 minutes.

Preparation of Colorant (1)

The following components were placed in a gallon kneader to prepare an aqueous solution.

| | |
|---|---|
| Water | 200 g |
| Ammonium humate | 16 g |

Then 200 g of carbon black (Mitsubishi #44) was added and to the solution, and the mixture was dispersed in the kneader.

Then 850 g of the above-prepared polyester resin (1) was added to the mixture. The mixture was kneaded at 100° C. to separate water therefrom to prepare a flushing colorant (1).

Preparation of Liquid Developer (1)

The following components were mixed and dispersed for 24 hours.

| | |
|---|---|
| Flushing colorant (1) | 90 parts |
| 20% liquid paraffin solution of an acrylic copolymer (liquid paraffin: CRYSTOL J-52; acrylic copolymer: lauryl methacrylate/methyl methacrylate = 80/20) | 150 parts |
| Carrier liquid: liquid paraffin (CRYSTOL J-52) | 200 parts |

Then 250 parts of a silicone oil (KF 96 having a viscosity of from 50 cst) were added to the mixture, and the mixture was additionally dispersed for 1 hour. Thus, a liquid developer of Example 1 was prepared. The diffusing speed of the carrier liquid was 2.1 mm/minute.

Example 2

Preparation of Liquid Developer (2)

The following components were mixed and kneaded at 120° C.

| | |
|---|---|
| Pigment Blue 15:3 (manufactured by Dainichiseika Color & Chemical Mfg. Co., Ltd.) | 25 parts |
| Polyester resin (1) | 75 parts |

The kneaded mixture was pulverized to prepare a pulverized mixture made of the colorant and polyester resin.

The following components were mixed and dispersed for 36 hours using a ball mill.

| | |
|---|---|
| The pulverized mixture prepared above | 80 parts |
| 10 % liquid paraffin solution of a copolymer (resin/liquid paraffin: CRYSTOL J-142; copolymer: Stearyl methacrylate/methyl methacrylate/methacrylic acid/ hydroxyrnethyl methacrylate = 85/7/4/4) | 150 parts |
| Liquid paraffin (CRYSTOL J-202) | 150 parts |

Then 250 parts of a silicone oil (KF 96 having a viscosity of 100 cst) were added to the mixture and the mixture was additionally dispersed for 1 hour using a ball mill. Thus, a liquid developer of Example 2 was prepared. The diffusing speed of the carrier liquid was 3.1 mm/minute.

Example 3

Preparation of Polyester Resin (2)

The procedure for preparation of the polyester resin (1) was repeated except that 1600 g of neopentyl glycol and 600 g of maleic acid were used. Thus, a polyester resin (2) having an acid value of 1.5 mg/KOH and a melt index of 75 g/10 minutes was prepared.

Preparation of Colorant (2)

The following components were mixed and dispersed in a gallon kneader to prepare a mixture.

| | |
|---|---|
| Water | 200 g |
| Carbon | 220 g |

(R330R manufactured by Cabot corporation)

Then 680 g of the above-prepared polyester resin (2) was added to the mixture and kneaded at 160° C. Then the mixture was additionally kneaded at 120° C. for 2 hours and the mixture was vacuum dried and cold pulverized. Thus, a flushing colorant (2) was prepared.

The following components were mixed and dispersed for 24 hours using a ball mill.

| | |
|---|---|
| Flushing colorant (2) | 70 parts |
| 20 % liquid paraffin solution of a copolymer | 120 parts |

(liquid paraffin: CRYSTOL J-52; copolymer: lauryl methacrylate/methyl methacrylate=80/20)

Then 200 parts of the liquid paraffin (CRYSTOL J-52) were added to the mixture, and the mixture was additionally dispersed for 1 hour. Thus, a liquid developer of Example 3 was prepared. The diffusing speed of a carrier liquid was 2.1 mm/minute.

Comparative Example 1

The procedure for preparation of the polyester resin (2) was repeated except that the resultant polyester resin (3) has an acid value of 8.5 mg/KOH and a melt index of 15 g/10 minutes. Then the procedure for preparation of the liquid developer in Example 3 was repeated except that the polyester resin (3) was used to prepare a liquid developer. The diffusing speed of the carrier liquid was 0.8 mm/minute.

Comparative Example 2

The procedure for preparation of the colorant (1) was repeated except that an epoxy resin (EPICOAT 1004) was used instead of the polyester resin (1) to prepare a colorant (3). The procedure for preparation of Example 1 was repeated except that the colorant (3) was used instead of the colorant (1) to prepare a liquid developer. The diffusing speed of the carrier liquid was 0.5 mm/minute.

Each of the liquid developers of Examples 1 to 3 and Comparative Examples 1 and 2 was set in a test machine i.e., the apparatus illustrated in FIG. 1 having a heat fixing device thereon to produce images on a receiving material. A plain paper T-6000 manufactured by Ricoh Co., Ltd. was used as a receiving material. The image fixation was performed in an oil-less mode. Image quality of the images and transfer efficiency of the developers were evaluated under the most suitable conditions.

The evaluation items and methods are as follows:

(1) Image density

The image density of the image was measured by a densitometer X-Rite.

(2) Resolution (3) Uniformity of solid image

The uniformity of the solid image was evaluated by comparison with the following 5-grade standard samples:

Rank 5: excellent

Rank 4: good

Rank 3: fair

Rank 2: bad

Rank 1: very bad (4) Diffusing speed of carrier liquid

NO. 2 filter paper manufactured by Toyo Roshi Kaisha, Ltd. was used as a filter paper.

The following is a quotation from Japanese Industrial Standard, JIS P 3801, concerning filter paper type 2 for chemical analysis.

1. Scope of Application

This standard defines filter papers for use in chemical analysis.

2. Type of Filter Papers

The filter paper type 2 is a filter paper for qualitative analysis which is used for filtering precipitation with medium size.

3. Material of the Filter Paper

The filter paper includes a selected cotton fiber as a main component.

4. Quality

The filter paper has an immaculate and uniform organization.

α cellulose content: Not less than 90%

Copper number: Not greater than 1.6 pH: from 5.0 to 8.0.

Ash content per 1 sheet of the filter paper for qualitative analysis: Not greater than 0.2%.

Flow time of water: Not greater than 120 sec.

Wet strength: Not less than 1.47 kPa (15 $cmH_2O$)

Precipitate retainability: Lead sulfate

5. Test Methods 5-1: pH

One gram of a sample filter paper, which is finely cut so as to have an area of about 100 $mm^2$, is placed in a conical flask having a volume of 100 ml. About 20 ml of boiling distilled water is added in the flask, the sample is pressed by a glass stick having a flattened tip to sufficiently penetrate water into the sample. Next, 50 ml of distilled water is further added to the flask to be mixed therewith.

The flask is heated for an hour such that water boils and then cooled to prepare a testing liquid.

After the electrode, standard buffer solution([1]), washing water and testing liquid have the same temperature as the measuring temperature, the pH is measured with a glass electrode pH meter while the fiber of the paper is included in the testing liquid.

When pH is measured, it is necessary that the pH is determined to a precision of ±0.05. The testing liquid is divided into three parts. When the pHs thereof are measured, the three pH data should not have a difference not less than 0.1.

([1]): Potassium hydrogen phthalate having a pH of 4.0 is used and a mixture of a primary phosphate and a secondary phosphate having pH of 7.0 is optionally used.

5-2: Ash content

At least 6 g of the sample is contained in a mass-known container([2]) and the container is set in an electric muffle furnace to be gradually heated until smoke is not discharged from a cover of the container. Then the cover is taken out and the sample is heated for about 2 hours at 700±25° C. to perform cineration sufficiently, followed by cooling to room temperature in a desiccator. Then the ash content is immediately measured. The ash content is calculated according to the following formula:

Ash content of filter paper (%)=ash mass (g)/dried sample mass (g)([3])

([2]): 20 ml platinum crucible having a cover is used as a container.

([3]): Dried sample mass means the mass of the sample dried at 105±2° C. so as to have a constant weight (up to 10 mg).

5-3: Flow Time of Water

Figure 6:
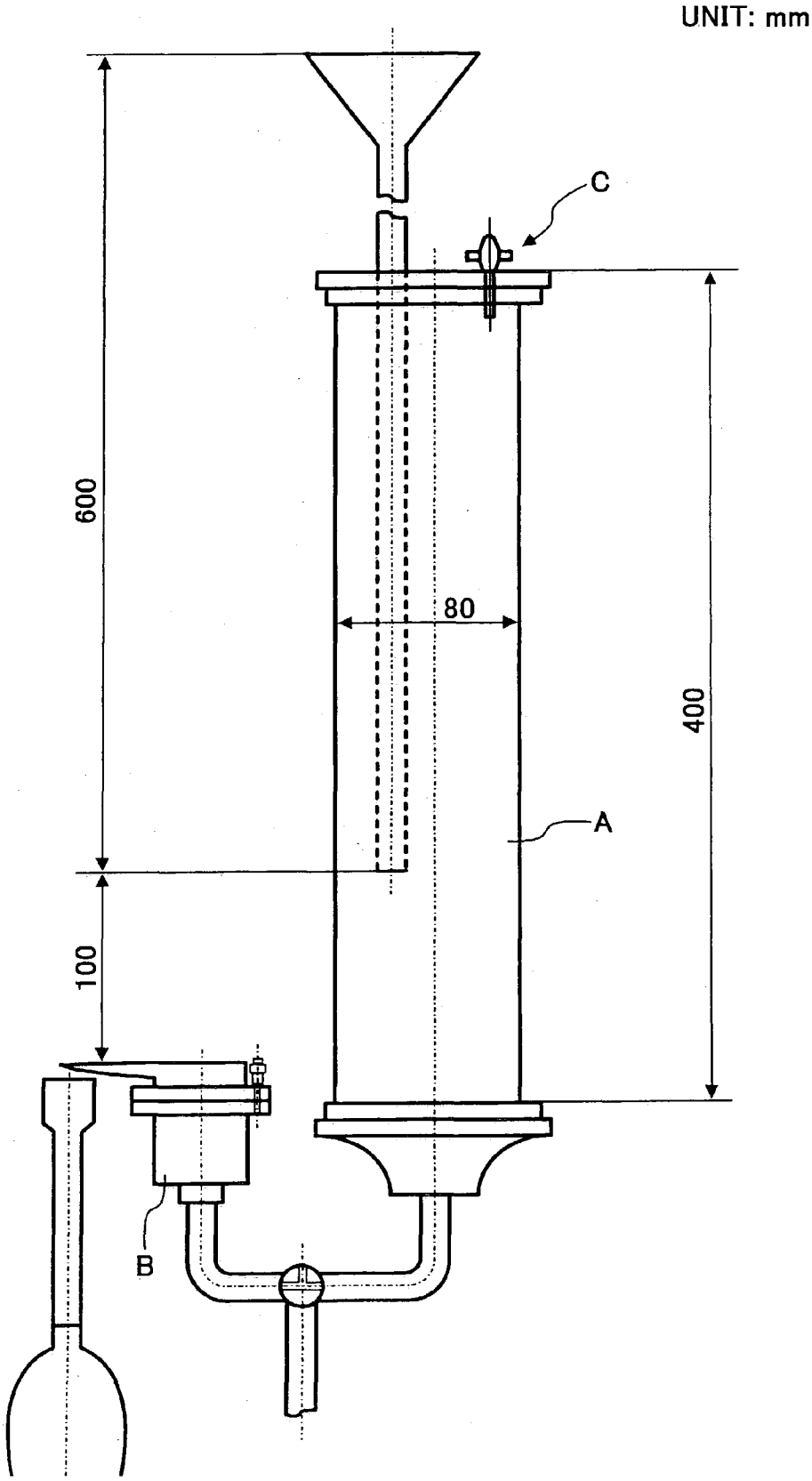

Distilled water having a temperature of 20±2° C. ([4]) and pre-filtered by a herzberg filtration rate tester is used. As illustrated in FIG. 6, the herzberg tester is constituted of a glass cylinder filled with water (A portion) and a cramper (B portion) clipping filter papers closely. A three-way stopcock is provided in a middle of a U-tube connecting the A and B portions. A distance between the surface of water in the B portion and a bottom of a funnel of the A portion are kept constant ([5]), SO that a constant water pressure is applied to the filter paper during the test. An air valve (C) provided on the cover of A portion is optionally opened in a case of irrigation. The air valve is closed to keep the inside of the container airtight.

Then the three-way stopcock is opened to feed the water in the A portion to the B portion. The time in seconds required to filter 100 ml of water with the filter paper set at the B portion is measured, which is the flow time of water.

([4]) A filter paper having finer openings than the test filter paper or a twofold test filter paper is used.

([5]) Normally 100 mm 5-4: Wet Strength

The herzberg filtration rate tester is used. The filter paper used for the flow time test is allowed to stand such that the water height is 100 mm. Then wet strength measurement is started. When the air valve (C) is slightly opened ([6]), the pressure applied to the filter paper increases, so that the filter paper is broken. Wet strength is represented as the height of the increased water in units of cm in the funnel.

([6]) The air valve is opened at a rate such that the water in the funnel increases at a rate of 20 mm to 30 mm per 5 seconds.

5-5: Precipitate Retainability

A newly precipitated slurry of lead sulfate is filtered on the conical flask using the test filter paper to prepare a testing liquid. After the flask is shaken, a black paper is placed underneath the flask to observe the testing liquid from the above thereof. When the testing liquid is transparent and the precipitation cannot be found by naked eyes, precipitate retainability is acceptable.

The method for preparing the testing liquid is as follows.

Remark: Not less than 4 sheets of samples are tested per 1 lot of the sample.

Forty ml of sulfuric acid of 3 mol/l and 80 ml of ethanol are added to 100 ml of an aqueous solution of lead acetate, and the mixture is allowed to stand for 4 hours. The mixture is agitated until the lead sulfate is uniformed in the liquid, and then about 50 ml of the mixture is filtered on conical flasks. Firstly, the precipitate on the filter paper is washed with sulfuric acid (1:20), and next with ethanol (95). The mixture of the filtrate and the washing liquid is used as the testing liquid.

(5) Fixation

The fixation was evaluated by a tape method. Provided that an image density after an operation of the tape method is performed is (IDa) and the image density before the operation of the tape method is performed is (IDb), an image residual rate is represented as (IDa)/(IDb). When the image residual rate was not less than 90%, the fixability of the image was ranked as A and when the result thereof was less than 90%, the fixability of the image was ranked as B.

(6) Average Particle Diameter

The average particle diameter of the toner in each liquid developer was measured by SA-CP3 manufactured by Shimadzu Corporation.

(7) Transfer Efficiency (8) Offset Resistance

The offset resistance was evaluated by comparison with the following 5-grade standard samples:

Rank 5: excellent
Rank 4: good
Rank 3: fair
Rank 2: bad
Rank 1: very bad

TABLE 1

| | Image Density | Resolution (line/mm) | Uniformity of solid image | Diffusing speed of carrier liquid (mm/min.) | Fixation | Average particle diameter (μm) | Transfer Transfer efficiency (%) | Offset resistance |
|---|---|---|---|---|---|---|---|---|
| Example 1 | 1.36 | 7.1 | Rank 4 | 2.1 | A | 1.66 | 95 | Rank 5 |
| Example 2 | 1.44 | 7.1 | Rank 4 | 3.1 | A | 1.56 | 95 | Rank 5 |
| Example 3 | 1.39 | 7.1 | Rank 4 | 2.6 | A | 1.93 | 94 | Rank 4 |

TABLE 1-continued

| | Image Density | Resolution (line/mm) | Uniformity of solid image | Diffusing speed of carrier liquid (mm/min.) | Fixation | Average particle diameter (μm) | Transfer Transfer efficiency (%) | Offset resistance |
|---|---|---|---|---|---|---|---|---|
| Comparative Example 1 | 1.21 | 6.3 | Rank 4 | 0.8 | B | 1.93 | 94 | Rank 3 |
| Comparative Example 2 | 0.56 | 5.3 | Rank 2 | 0.5 | B | 2.36 | 94 | Rank 4 |

As can be understood from Table 1, the image produced by the developer of Example 1 is superior to the image in Example 2 in image density and uniformity of solid image, because humic acid was used in Example 1 and the colorant used in Example 1 was subjected to a flushing treatment.

Although the colorant used in Example 3 was subjected to a flushing treatment, the density of the image of Example 3 was slightly low, because humic acid was not used in Example 3.

The fixation of the image produced by the developer of Comparative Example 1 was bad, because the developer had a high viscosity and the diffusing speed of the carrier liquid in a filter paper was low.

The developer of Comparative Example 2 had low charge retention rate (i.e., had a large average particle diameter) because the epoxy resin was used.

Example 4

The procedure for preparation and evaluation of the developer in Example 1 was repeated except that the image forming apparatus illustrated in FIG. 2 was used and the development was performed after the toner layer had been subjected to a corona discharge treatment at 3000 V. As a result, the resolution of the image was improved as shown in Table 2.

TABLE 2

| | Image Density | Resolution (line/mm) | Uniformity of solid image | Diffusing speed of carrier liquid (mm/min.) | Fixation | Average particle diameter (μm) | Transfer efficiency (%) | Offset resistance |
|---|---|---|---|---|---|---|---|---|
| Example 4 | 1.33 | 8.0 | Rank 4 | 2.1 | A | 1.66 | 95 | Rank 5 |

Example 5

The procedure for preparation and evaluation of the developer in Example 1 was repeated except that the image forming apparatus illustrated in FIG. 2 was used and a silicone oil KF 96 having a viscosity of 300 cst was applied to the surface of the photoreceptor by the pre-wet felt 41 such that the silicone oil layer was formed thereon in a thickness of about 0.5 μm, before the image developing process. As a result, the image density and the transfer efficiency were improved as shown in Table 3.

TABLE 3

| | Image Density | Resolution (line/mm) | Uniformity of solid image | Diffusing speed of carrier liquid (mm/min.) | Fixation | Average particle diameter (μm) | Transfer efficiency (%) | Offset resistance |
|---|---|---|---|---|---|---|---|---|
| Example 5 | 1.46 | 7.1 | Rank 4 | 3.1 | A | 1.56 | 98 | Rank 5 |

Example 6

The procedure for preparation and evaluation of the developer in Example 1 was repeated except that the image forming apparatus illustrated in FIG. 3 having an intermediate transfer roller 12 (urethane rubber, surface treated with fluorine) was used. As a result, the image density was improved as shown in Table 4.

TABLE 4

| | Image Density | Resolution (line/mm) | Uniformity of solid image | Diffusing speed of carrier liquid (mm/min.) | Fixation | Average particle diameter (μm) | Transfer efficiency (%) | Offset resistance |
|---|---|---|---|---|---|---|---|---|
| Example 6 | 1.54 | 7.1 | Rank 4 | 3.1 | A | 1.56 | 98 | Rank 5 |

Example 7

The procedure for preparation and evaluation of the developer in Example 1 was repeated except that the image forming apparatus illustrated in FIG. 4 was used and a fluorine-containing acrylic block copolymer (MODIPER F210 manufactured by Nippon Yushi Inc.) was applied to the surface of the photoreceptor to form a water- and oil-repellant layer having a thickness of 3 μm. The contact angle of the surface of the photoreceptor against the silicone oil (KF 96 having a viscosity of 100 cst) was 45°.

TABLE 5

| | Image Density | Resolution (line/mm) | Uniformity of solid image | Diffusing speed of carrier liquid (mm/min.) | Fixation | Average particle diameter (μm) | Transfer efficiency (%) | Offset resistance |
|---|---|---|---|---|---|---|---|---|
| Example 7 | 1.59 | 7.1 | Rank 5 | 3.1 | A | 1.56 | 100 | Rank 5 |

This document claims priority and contains subject matter related to Japanese Patent Application No. 2002-196491 filed on Jul. 4$^{th}$, 2002 incorporated herein by reference.

All references, standards, articles, patents, applications, publications, etc. mentioned herein are incorporated by reference, as are all brochures, etc. relating to commercial materials mentioned herein.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic liquid developer comprising:

a carrier liquid comprising a liquid paraffin; and toner particles dispersed in the carrier liquid and comprising a colorant and a resin component, wherein the resin component comprises not less than 50% by weight based on total weight of resin component of a polyester resin, wherein when 0.3 g of the liquid developer is dropped on a filter paper from a point of 10 mm height, the carrier liquid diffuses in the filter paper at a speed not lower than 1 mm/minute;

wherein an acid value of the polyester resin is from 0 to 10 mg/KOH.

2. The liquid developer according to claim 1, wherein a melt index of the polyester resin is from 25 g/10 minutes to 700 g/10 minutes.

3. The liquid developer according to claim 1, wherein the colorant comprises a colorant that has been subjected to a flushing treatment using a polyester resin in a presence of a compound selected from the group consisting of humic acid, salts of humic acid and humates.

4. The liquid developer according to claim 1, wherein the liquid paraffin has a flash point not lower than 130° C. and a viscosity not lower than 3 mPa·sec. at 40° C. as a main component.

5. The liquid developer according to claim 1, wherein the carrier liquid further comprises a linear silicone oil having a flash point not lower than 210° C.

6. The liquid developer according to claim 1, wherein the toner particles are present in the liquid developer in an amount not less than 10% by weight based on total weight of the liquid developer.

7. The liquid developer according to claim 1, wherein the toner particles have an average particle diameter of from 1 μm to 5 μm.

8. An image forming method comprising:

applying the liquid developer according to claim 1 on a developing member selected from the group consisting of rollers and belts to form a layer of the liquid developer on the developing member; and developing an electrostatic latent image on an image bearing member with the liquid developer on the developing member to form a toner image on the image bearing member.

9. The image forming method according to claim 8, wherein a melt index of the polyester resin of the liquid developer is from 25 g/10 minutes to 700 g/10 minutes.

10. The image forming method according to claim 8, wherein the colorant of the liquid developer comprises a colorant that has been subjected to a flushing treatment using a polyester resin in a presence of a compound selected from the group consisting of humic acid, a salt of humic acid and humates.

11. The image forming method according to claim 8, wherein the liquid paraffin has a flash point not lower than 130° C. and a viscosity not lower than 3 mPa·sec. at 40° C. as a main component.

12. The image forming method according to claim 8, wherein the carrier liquid of the liquid developer further comprises a linear silicone oil having a flash point not lower than 210° C.

13. The image forming method according to claim 8, wherein the toner particles are contained in the liquid developer in an amount not less than 10% by weight based on total weight of the liquid developer.

14. The image forming method according to claim 8, wherein the toner particles present in the liquid developer have an average particle diameter of from 1 μm to 5 μm.

15. The image forming method according to claim 8, wherein the layer of the liquid developer has a thickness of from 1 μm to 15 μm.

16. The image forming method according to claim 8, further comprising:

subjecting the layer of the liquid developer on the developing member to corona discharge treatment.

17. The image forming method according to claim 8, further comprising:

wetting the image bearing member having the electrostatic latent image thereon with a pre-wet liquid.

18. The image forming method according to claim 8 comprising:

transferring the toner image on the image bearing member onto an intermediate transfer medium; and transferring the toner image on the intermediate transfer medium on a receiving material.

19. The image forming method according to claim 8, wherein a surface of the image bearing member has water and oil repellency.

20. An image forming apparatus comprising:

an image bearing member;

a charger configured to charge the image bearing member;

an irradiator configured to irradiate the image bearing member with light to form an electrostatic latent image on the image bearing member;

an image developer configured to develop the electrostatic latent image with a layer of a liquid developer formed on a developing member selected from the group consisting of rollers and belts to form a toner image on the image bearing member;

a transferring device to transfer a toner image onto a receiving material; and a cleaner configured to clean a surface of the image bearing member, wherein the liquid developer is the liquid developer according to claim 1.

21. The image forming apparatus according to claim 20, wherein a melt index of the polyester resin is from 25 g/10 minutes to 700 g/10 minutes.

22. The image forming apparatus according to claim 20, wherein the colorant comprises a colorant that has been subjected to a flushing treatment using a polyester resin in a presence of a compound selected from the group consisting of humic acid, a salt of humic acid and humates.

23. The image forming apparatus according to claim 20, wherein the liquid paraffin has a flash point not lower than 130° C. and a viscosity not lower than 3 mPa·sec. as a main component.

24. The image forming apparatus according to claim 20, wherein the carrier liquid further comprises a linear silicone oil having a flash point not lower than 210° C.

25. The image forming apparatus according to claim 20, wherein the toner particles are present in the liquid developer in an amount not less than 10% by weight based on total weight of the liquid developer.

26. The image forming apparatus according to claim 20, wherein the toner particles have an average particle diameter of from 1 μm to 5 μm.

27. The image forming apparatus according to claim 20, wherein the layer of the liquid developer has a thickness of from 1 μm to 15 μm.

28. The image forming apparatus according to claim 20, further comprising:

a second charger configured to perform corona discharge on the layer of the liquid developer on the developing member.

29. The image forming apparatus according to claim 20, further comprising:

a wetting device configured to apply a pre-wet liquid to the image bearing member having the electrostatic latent image thereon.

30. The image forming apparatus according to claim 20, further comprising:

an intermediate transfer device configured to receive the toner image on the image bearing member and transfer the toner image onto the receiving material.

31. The image forming apparatus according to claim 20, wherein a surface of the image bearing member has water and oil repellency.

* * * * *